US008028931B2

(12) United States Patent
Matsumoto et al.

(10) Patent No.: US 8,028,931 B2
(45) Date of Patent: Oct. 4, 2011

(54) LIQUID DISCHARGE DEVICE

(75) Inventors: Ayumu Matsumoto, Kirishima (JP); Manabu Hibi, Nagoya (JP)

(73) Assignees: Kyocera Corporation, Kyoto (JP); Brother Kogyo Kabushiki Kaisha, Aichi (JP)

( * ) Notice: Subject to any disclaimer, the term of this patent is extended or adjusted under 35 U.S.C. 154(b) by 46 days.

(21) Appl. No.: 12/295,204

(22) PCT Filed: Mar. 26, 2007

(86) PCT No.: PCT/JP2007/056247

§ 371 (c)(1),
(2), (4) Date: Sep. 1, 2009

(87) PCT Pub. No.: WO2007/116699

PCT Pub. Date: Jan. 18, 2007

(65) Prior Publication Data

US 2010/0001095 A1 Jan. 7, 2010

(30) Foreign Application Priority Data

Mar. 29, 2006 (JP) ..... 2006-091775

(51) Int. Cl.
*B05B 1/08* (2006.01)
*B05B 3/04* (2006.01)

(52) U.S. Cl. ..... 239/102.1; 239/102.2; 347/68; 347/71; 347/72

(58) Field of Classification Search ..... 239/102.1, 239/102.2, 146–176; 347/68, 71, 72
See application file for complete search history.

(56) References Cited

U.S. PATENT DOCUMENTS

| | | | | |
|---|---|---|---|---|
| 5,818,482 | A * | 10/1998 | Ohta et al. | 347/70 |
| 5,872,583 | A * | 2/1999 | Yamamoto et al. | 347/70 |
| 6,979,077 | B2 | 12/2005 | Sakaida | |
| 7,524,036 | B2 | 4/2009 | Mataki | |
| 2003/0156166 | A1 | 8/2003 | Sakaida | |
| 2003/0210308 | A1 * | 11/2003 | Okubo | 347/72 |
| 2004/0113994 | A1 * | 6/2004 | Shinkai | 347/68 |
| 2005/0205687 | A1 * | 9/2005 | Chang | 239/102.2 |
| 2006/0044360 | A1 | 3/2006 | Sugahara | |
| 2006/0050111 | A1 | 3/2006 | Mataki | |

FOREIGN PATENT DOCUMENTS

| | | | |
|---|---|---|---|
| EP | 1338420 | A1 | 8/2003 |
| EP | 1629980 | A2 | 3/2006 |
| JP | 2005144917 | A | 6/2005 |

OTHER PUBLICATIONS

European search report for corresponding European application 07739685.1 lists the references above.
International Search Report for corresponding PCT application PCT/JP2007/056247 lists the reference above.

* cited by examiner

*Primary Examiner* — Dinh Nguyen
(74) *Attorney, Agent, or Firm* — DLA Piper LLP (US)

(57) ABSTRACT

A liquid discharge device (1) has a pressure chamber (3), a nozzle (4), and a communication path (5) that interconnects the pressure chamber (3) and the nozzle (4). A region that has a specific length $L_1$ and lies from the position (8) of the boundary between the communication path (5) of the pressure chamber (3) toward the nozzle (4) is formed as a narrow section (9) that has an opening area $S_1$ smaller than the opening area $S_0$ of a region closer to the nozzle (4) than the narrow section (9). In the liquid discharge device (1), the narrow section (9) functions to damp micro vibration that occurs in liquid in the communication path (5), and this allows liquid drops having a pre-designed volume and flying speed to be discharged from every nozzle (4) on a board (2)

2 Claims, 8 Drawing Sheets

LIQUID DISCHARGE DEVICE

TECHNICAL FIELD

The present invention relates to a liquid discharge device.

BACKGROUND ART

Liquid discharge devices, in which a plurality of pressure chambers to be filled with a liquid are arranged in a planar direction on one surface of a board, a nozzle for discharging the liquid as a liquid drop is formed for each of the pressure chambers on the opposite surface of the board, each of the pressure chambers and the corresponding nozzle are interconnected by a communication path to be filled with a liquid, and a piezoelectric actuator including a piezoelectric element is disposed on the one surface, on which the pressure chambers are formed, of the board, have been widely used as piezoelectric ink jet heads in recording devices utilizing ink jet recording systems, for example, ink jet printers and ink jet plotters.

In the above-mentioned liquid discharge device, when the piezoelectric actuator is vibrated so as to repeat a state where it is deflected in the thickness direction and a state where the deflection is released by applying a predetermined driving voltage pulse to the piezoelectric element with the pressure chamber and the communication path respectively filled with the liquids, the volume of the pressure chamber is increased or decreased with the vibration so that the liquid in the pressure chamber vibrates. The vibration is transmitted to the nozzle through the liquid in the communication path so that a meniscus of the liquid formed in the nozzle vibrates. A part of the liquid forming the meniscus is separated as a liquid drop with the vibration, and the liquid drop is discharged from the nozzle. In the case of the piezoelectric ink jet head, the liquid drop (ink drop) discharged from the nozzle flies to a paper surface disposed opposite to the nozzle, to reach the paper surface, so that dots are formed on the paper surface.

Conventionally, the communication path has been generally formed so as to have a substantially constant opening area, considering that the vibration of the liquid in the pressure chamber is transmitted to the meniscus in the nozzle as smoothly as possible. For example, Patent Document 1 describes a liquid discharge device in which a communication path is formed so as to have a predetermined opening area from an opening on the side of a pressure chamber to a position connecting with a nozzle, and the nozzle is formed in a tapered shape such that its opening area gradually decreases to its tip from a position connecting with the communication path.

However, consideration by the inventors have proved that in a conventional liquid discharge device in which the opening area of a communication path is made substantially constant, as described in Patent Document 1, when a piezoelectric actuator is driven, to discharge a liquid drop from a nozzle by a mechanism previously described, a liquid drop having a previously designed volume and flying speed cannot be discharged from the nozzle because micro vibration of a liquid is generated in the communication path, and the micro vibration is overlapped with vibration of a liquid in a pressure chamber so that the volume and the flying speed of a formed liquid drop vary.

As a cause of this, the inventors have considered that a part of vibration transmitted to the liquid in the communication path is transmitted to the meniscus of the liquid in the nozzle, as previously described, while the remainder thereof is reflected toward the pressure chamber in the vicinity of an inlet to the nozzle because the opening area of the communication path is larger than the opening area of the nozzle. That is, the remainder of the vibration reflected in the vicinity of the inlet to the nozzle is repeatedly reflected between the vicinity of the inlet to the nozzle and a surface opposite the inlet to the communication path on an inner wall surface of the pressure chamber to generate a standing wave, to micro-vibrate the liquid in the communication path.

The period of the micro vibration is mainly defined by the distance between the opposite surfaces, between which the vibration is repeatedly reflected, for example, and is a small value that is a small fraction of the period of the vibration of the liquid generated by driving the piezoelectric actuator. When the micro vibration is overlapped with the vibration of the liquid generated by driving the piezoelectric actuator, however, pressure for discharge, which is applied to the meniscus of the liquid in the nozzle, becomes excessively high or excessively low depending on the amount of shift in phase between both the vibrations. Therefore, the volume and the flying speed of the formed liquid drop vary, as previously described.

In a case where the micro vibration is overlapped with the vibration of the liquid generated by driving the piezoelectric actuator so that the pressure for discharge, which is applied to the meniscus of the liquid in the nozzle, becomes excessively higher than a normal value, for example, when the piezoelectric actuator is driven to discharge the liquid drop from the nozzle, a so-called head high-speed drop being minuter and having a higher flying speed than a predetermined liquid drop is easily discharged as the first drop.

The amount of shift in phase between the vibration of the liquid generated by driving the piezoelectric actuator and the micro vibration is mainly determined by the length of the communication path, for example. Therefore, the volume and the flying speed of a liquid drop discharged from one nozzle do not drastically vary while the liquid discharge device is employed. However, the volumes and the flying speeds of liquid drops discharged from a plurality of nozzles formed on the one board in the liquid discharge device easily vary for each of the nozzles. In the case of the piezoelectric ink jet head, the head high-speed drop is generated, and the volumes and the flying speeds of the liquid drops discharged from the plurality of nozzles vary, so that the image quality of a formed image is reduced.

Patent Document 1: Japanese Unexamined Patent Publication No. 2005-144917 (Paragraph [0029], FIGS. 1 and 2)

DISCLOSURE OF THE INVENTION

Problems to be Solved by the Invention

An object of the present invention is to provide a liquid discharge device that can respectively discharge liquid drops each having a previously designed volume and flying speed from all nozzles on a board by damping micro vibration of a liquid generated in a communication path.

Means for Solving the Problems

The present invention is directed to a liquid discharge device including (A) a pressure chamber to be filled with a liquid, (B) a nozzle for discharging the liquid as a liquid drop, (C) a communication path that interconnects the pressure chamber and the nozzle and to be filled with a liquid, and (D) a piezoelectric actuator that includes a piezoelectric element, and vibrates due to the deformation of the piezoelectric element to increase or decrease the volume of the pressure chamber, to vibrate the liquid in the pressure chamber and transmits the vibration to the nozzle through the liquid in the communication path, to discharge the liquid drop from the nozzle, in which a region having a predetermined length directed toward the nozzle from a boundary position between the pressure chamber of the communication path is a narrow section having a smaller opening area than a opening area of a region closer to the nozzle than the narrow section of the communication path.

According to the present invention, micro vibration of the liquid generated in the communication path can be particularly damped by passing vibration of the liquid through the narrow section having a small opening area and having a high flow path resistance, which is provided at the boundary position between the pressure chamber of the communication path, to transmit the vibration between the pressure chamber and the communication path. Therefore, liquid drops each having a previously designed volume and flying speed can be discharged from all nozzles communicating with all communication paths on the board by providing narrow sections, described above, for all the communication paths, previously described.

Moreover, according to the present invention, the necessity of providing a resistive portion serving as a flow path resistance in the pressure chamber is eliminated. In a case where the board constituting the liquid discharge device is formed by laminating a plate material having an opening serving as a pressure chamber or the like formed therein, a plate material having an opening serving as a communication path formed therein, and a plate material having a nozzle formed therein, for example, therefore, even if the plate materials are aligned and laminated after being processed with conventional processing accuracy, it is possible to prevent the opening area particularly in a connection portion between the pressure chamber and the communication path from varying with sufficient dimensional precision ensured. Therefore, it is also possible to prevent the volumes and the flying speeds of the liquid drops discharged from the plurality of nozzles formed on the one board in the liquid discharge device from varying for each of the nozzles due to a difference occurring in the effect of damping the micro vibration depending on the variation in the opening area.

Note that it is preferable that the opening area of the narrow section is 20 to 60% of the opening area of the region closer to the nozzle than the narrow section, considering that the vibration of the liquid in the pressure chamber, which is generated by driving the piezoelectric actuator, is transmitted through the narrow section to the liquid in the communication path as efficiently as possible while maintaining the effect of damping the micro vibration by the narrow section at a favorable level. Furthermore, it is preferable that the length, in the length direction of the communication path, of the narrow section is 10 to 20% of the overall length of the communication path from the same reason.

Effects of the Invention

According to the present invention, there can be provided a liquid discharge device capable of discharging liquid drops each having a previously designed volume and flying speed from all nozzles on a board by damping micro vibration generated in a communication path.

DESCRIPTION OF REFERENCE NUMERALS AND SIGNS

Figure 1:
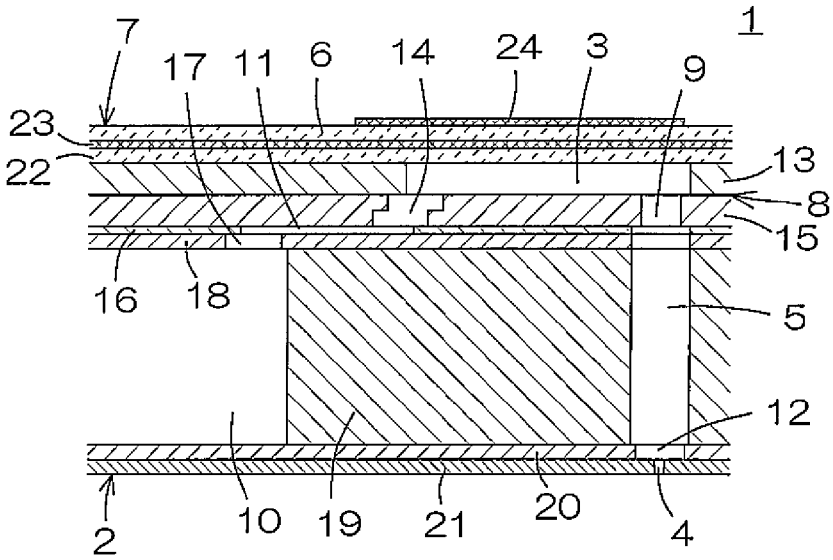
FIG. 1 is a cross-sectional view showing a liquid discharge device according to an embodiment of the present invention in particularly enlarged fashion.

1: liquid discharge device
2: board
3: pressure chamber
4: nozzle
5: communication path
6: piezoelectric element
7: piezoelectric actuator
8: boundary position
9: narrow section
10: supply path
11: contraction section
12: connection section
13: first plate material
14: connection section
15: second plate material
16: third plate material
17: connection section
18: fourth plate material
19: fifth plate material
20: sixth plate material
21: seventh plate material
22: vibrating plate
23: common electrode
24: discrete electrode
25: conical tapered section
26: straight section

BEST MODE FOR CARRYING OUT THE INVENTION

Figure 2:
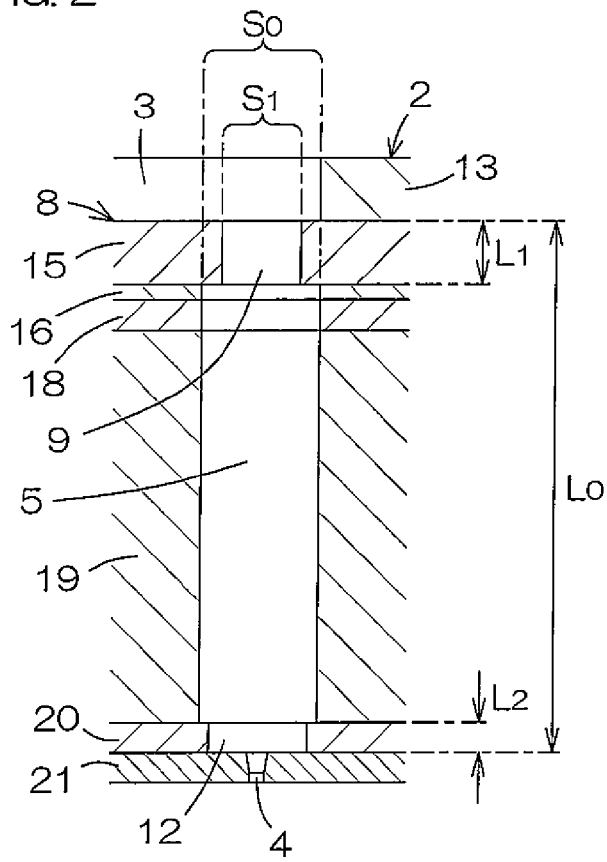
FIG. 2 is a cross-sectional view showing a portion of a communication path serving as a principal part of the liquid discharge device according to the present embodiment in further enlarged fashion.

FIG. 1 is a cross-sectional view showing a liquid discharge device according to an embodiment of the present invention in partially enlarged fashion. FIG. 2 is a cross-sectional view showing a portion of a communication path serving as a principal part of the liquid discharge device according to the present embodiment in further enlarged fashion. Referring to FIGS. 1 and 2, in the liquid discharge device 1 according to the present embodiment, a pressure chamber 3 is formed on an upper surface of a board 2, a nozzle 4 is formed so as to correspond to the pressure chamber 3 on a lower surface of the board 2, the pressure chamber 3 and the nozzle 4 are interconnected by a communication path 5 passing through the board 2, and a piezoelectric actuator 7 including a thin plate-shaped piezoelectric element 6 in a transverse vibration mode is laminated on the upper surface, on which the pressure chamber 3 is formed, of the board 2. Respective pluralities of pressure chambers 3, nozzles 4, and communication paths 5 are arranged in a planar direction on the one board 2, which is not illustrated.

A region having a predetermined length $L_1$ directed toward the nozzle 4 from a boundary position 8 between the pressure chamber 3 of the communication path 5 is a narrow section 9 having a smaller opening area and having a higher flow path resistance than a region, closer the nozzle 4 than the narrow section 9 of the communication path 5. Vibration of a liquid is always transmitted between the pressure chamber 3 and the communication path 5 after passing through the narrow section 9. This particularly allows micro vibration of the liquid generated in the communication path 5 to be damped, allowing a liquid drop, having a previously designed volume and flying speed, excluding the micro vibration, to be discharged from the nozzle 4.

That is, the boundary position 8 between the pressure chamber 3 and the communication path 5 generally corresponds to a node of a vibrational waveform between the vibration of the liquid in the pressure chamber 3 and the vibration of the liquid in the communication path 5. When the narrow section 9 having a small opening area, having a predetermined length in the length direction of the communication path 5, is provided at the boundary position 8, however, an inner wall surface of the narrow section 9 can damp the micro vibration because it functions to restrain an antinode of the waveform of the micro vibration.

It is preferable that the opening area $S_1$ of the narrow section 9 is in a range of 20 to 60% and particularly 30 to 50% of the opening area $S_0$ of the region, closer to the nozzle 4 than the narrow section 9, of the communication path 5. When the opening area $S_1$ is less than the above-mentioned range, the micro vibration can be more effectively damped. However, the damping amount of vibration, generated by driving the piezoelectric actuator 7 and transmitted from the liquid in the pressure chamber 3 to the liquid in the communication path 5, for discharging a liquid drop is also increased. This may cause the volume and the flying speed of the liquid drop discharged from the nozzle 4 to be rather reduced. When the opening area $S_1$ exceeds the above-mentioned range, the effect of damping the micro vibration of the liquid by the narrow section 9 may be insufficient.

It is preferable that the length $L_1$, in the length direction of the communication path 5, of the narrow section 9 is 10 to 20% and particularly 12 to 18% of the overall length $L_0$ of the communication path 5. When the length $L_1$ is less than the above-mentioned range, the effect of damping the micro vibration of the liquid by the narrow section 9 may be insufficient. When the length $L_1$ exceeds the above-mentioned range, the micro vibration can be more effectively damped. However, the damping amount of the vibration, generated by driving the piezoelectric actuator 7 and transmitted from the liquid in the pressure chamber 3 to the liquid in the communication path 5, for discharging a liquid drop is also increased. This may cause the volume and the flying speed of the liquid drop discharged from the nozzle 4 to be rather reduced.

Note that the configuration of the liquid discharge device according to the present invention is suitably employed particularly when the opening area $S_0$ of the region, closer to the nozzle than the narrow section 9, of the communication path 5 is in a range of 0.00785 to 0.0490625 $mm^2$ (the opening diameter thereof is 100 μm to 250 μm) and particularly 0.011304 to 0.0314 $mm^2$ (the opening diameter thereof is 120 μm to 200 μm) and the overall length $L_0$ of the communication path 5 is in a range of 400 to 1400 μm and particularly 500 to 1200 μm, considering that the effect of providing the narrow section 9, previously described, is more effectively exhibited. That is, when the opening area $S_0$ is in the above-mentioned range and the opening area $S_1$ of the narrow section 9 is 20 to 60% of the opening area $S_0$, or the overall length $L_0$ of the communication path 5 is in the above-mentioned range and the length $L_1$ of the narrow section 9 is 10 to 20% of the overall length $L_0$, the micro vibration can be more effectively damped.

A supply path 10 is used for supplying a liquid from a supply source (a tank or the like) (not shown) to the plurality of pressure chambers 3 arranged on the board 2. The supply path 10 and the pressure chamber 3 are connected to each other through a very thin contraction section 11 in order to prevent the vibration of the liquid in the pressure chamber 3 from being transmitted to the liquid in the other pressure chamber 3 through the supply path 10. Furthermore, an end, on the side of the nozzle 4 having a small opening area, of the communication path 5 having a large opening area is a connection section 12 having an opening area smaller than the communication path 5 and larger than the nozzle 4 in order to transmit the vibration transmitted from the liquid in the pressure chamber 3 in a concentrated manner to a meniscus of the liquid in the nozzle 4 from the liquid in the communication path 5 to reduce the percentage of the vibration reflected on the connection section without being transmitted to the meniscus.

A first plate material 13 having a through hole serving as the pressure chamber 3 formed therein, a second plate material 15 having a through hole serving as the narrow section 9 of the communication path 5 and a through hole serving as a connection section 14 for interconnecting the pressure chamber 3 and the contraction section 11 formed therein, a third plate material 16 having a through hole serving as an upper end of a region connecting with the narrow section 9 of the communication path 5 and a through hole serving as the contraction section 11 formed therein, a fourth plate material 18 having a through hole serving as a portion connecting with the upper end of the communication path 5 and a through hole serving as a connection section 17 for interconnecting the contraction section 11 and the supply path 10 formed therein, a fifth plate material 19 having a through hole serving as the remainder of the communication path 5 and a through hole serving as the supply path 10 formed therein, a sixth plate material 20 having a through hole serving as the connection section 12 formed therein, and a seventh plate material 21 having the nozzle 4 formed therein are laminated in this order while being aligned and are integrated, to form the board 2 on which the above-mentioned sections are formed.

Usable as each of the plate materials is one formed in the shape of a flat plate having a predetermined thickness of a metal, ceramic, resin, or the like and having a through hole having a predetermined planar shape to be each of the sections formed at its predetermined position by etching utilizing photolithography, for example. The overall length $L_0$ of the communication path 5 and the length $L_1$ of the narrow section 9 can be respectively adjusted within the ranges previously described by changing the thickness of each of the plate materials. Therefore, the overall length $L_0$ of the communication path 5 and the length $L_1$ of the narrow section 9 can be made uniform with high accuracy in all the communication paths 5 on the one piezoelectric actuator 7. Furthermore, the opening area $S_0$ of the communication path 5 and the opening area $S_1$ of the narrow section 9 can be respectively adjusted in the ranges previously described by changing the opening area of the through hole formed in the plate material by etching or the like.

When the plate material is formed of a metal, examples of the metal include an Fe—Cr based alloy, an Fe—Ni based alloy, and a WC-TIC based alloy. Particularly, the Fe—Ni based alloy and the Fe—Cr based alloy (e.g., SUS430, SUS316, SUS-316L, etc.) are preferable, considering corrosion resistance to a liquid such as ink and processability.

Figure 3:
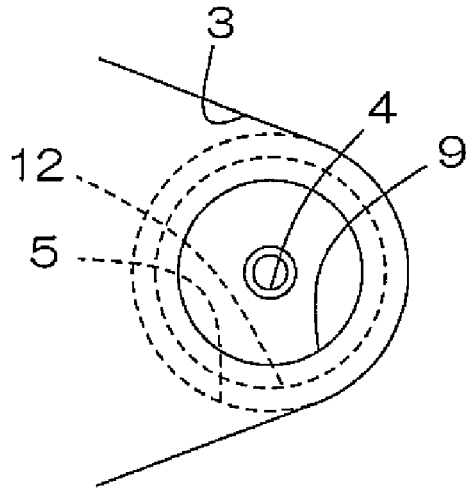
FIG. 3 is a plan view showing a portion of the communication path in further enlarged fashion.
Figure 4:
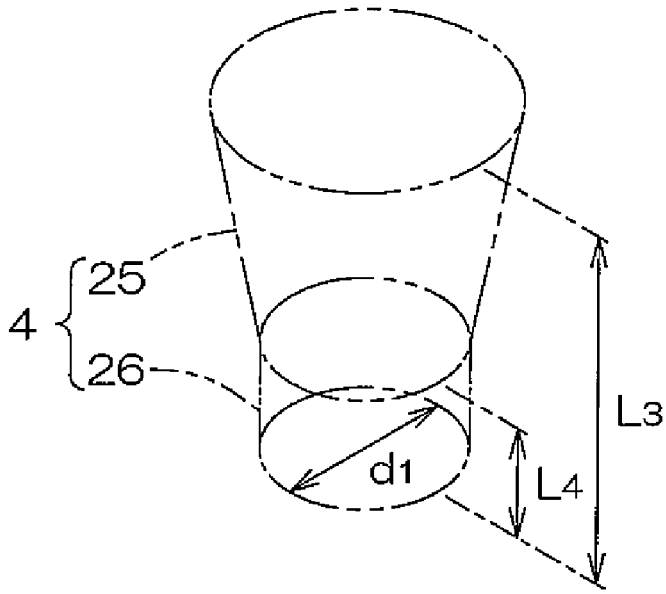
FIG. 4 is a perspective view showing the overall shape of a nozzle.

It is preferable that all the respective cross-sectional shapes, in the planar direction of the board 2 perpendicular to the length direction of the communication path 5, the narrow section 9, and the connection section 12 are circular, as shown in FIGS. 3 and 4, because the cross-sectional shape in the same direction of the nozzle 4 is generally circular, as shown in FIGS. 3 and 4, considering that the vibration transmitted to the liquid in the communication path 5 through the narrow section 9 is efficiently transmitted to the meniscus of the liquid in the nozzle 4 through the connection section 12. Furthermore, each of the plate materials can be also formed by laminating a plurality of thinner plate materials each having a predetermined through hole formed therein, which is not illustrated.

The piezoelectric actuator 7 includes a thin plate-shaped vibrating plate 22, a layered common electrode 23, and a thin plate-shaped piezoelectric element 6 in a transverse vibration mode, laminated in this order on the board 2 and each having dimensions covering the plurality of pressure chambers 3, and layered discrete electrodes 24 respectively pattern-formed in a predetermined planar shape so as to correspond to the pressure chambers 3 on the piezoelectric element 6.

The piezoelectric element 6 can be formed in a thin plate shape of lead zirconium titanate (PZT) based piezoelectric ceramic such as PZT or ceramic having one type or more types of oxides of lanthanum, barium, niobium, zinc, nickel, manganese, etc. added to the PZT, such as PLZT. Furthermore, the piezoelectric element 6 can be also formed of piezoelectric ceramic mainly composed of lead magnesium niobate (PMN), lead nickel niobate (PNN), lead zinc niobate, lead manganese niobate, lead antimony stannate, lead titanate, barium titanate, or the like.

The vibrating plate 22 can be also formed of the same piezoelectric ceramic as the piezoelectric element 6 in addition to being formed in a plate shape having a predetermined thickness of a metal such as molybdenum, tungsten, tantalum, titanium, platinum, iron, or nickel, an alloy of the above-mentioned metals, stainless steel, or the like. Furthermore, the vibrating plate 22 can be also formed of a metal superior in conductivity, for example, gold, silver, platinum, copper, or aluminum to omit the common electrode 23.

Each of the common electrode 23 and the discrete electrode 24 can be also formed by being coated with a conductive paste including fine particles of each of the above-mentioned metals, dried, and then further calcined, as needed, in addition to being formed of a foil composed of a metal, superior in conductivity, such as gold, silver, platinum, copper, or aluminum, a plating film, a vacuum evaporation film, or the like.

Examples of a method for pattern-forming the discrete electrode 24 formed of the plating film or the vacuum deposition film include, a method of selectively exposing only a region where the discrete electrode 24 is formed on a surface of the piezoelectric element 6 and selectively forming a film in the exposed region with the other region covered with a plating mask, and a method of forming a film on the whole surface of the piezoelectric element 6, then covering only a region corresponding to the discrete electrode 24 in the film with an etching mask to expose the other region, and selectively etching away the film in the exposed region. Furthermore, in the case of a coating film composed of a conductive paste, the conductive paste may be directly pattern-formed on the surface of the piezoelectric element 6 by a printing method such as a screen printing method.

The piezoelectric element 6 and the vibrating plate 22, each composed of piezoelectric ceramic, can be formed by forming a green sheet including a compound to be piezoelectric ceramic, previously described, in a predetermined planar shape by calcination, followed by calcination. Particularly when both the piezoelectric element 6 and the vibrating plate 22 are formed of piezoelectric ceramic, it is possible to produce a laminate in which a layer of a conductive paste to be the common electrode 23 is sandwiched between green sheets to be their respective layers by calcination and calcine the laminate at a time to obtain a laminate having the piezoelectric element 6, the common electrode 23, and the vibrating plate 22 laminated therein.

If the discrete electrode 24 is pattern-formed by the previously described method on the surface of the piezoelectric element 6 in the laminate, the piezoelectric actuator 7 is formed. The liquid discharge device 1 is configured by fixing the piezoelectric actuator 7 on a surface, on which the pressure chamber 3 is formed, of the board 2 by bonding with adhesives, for example. Preferable as the adhesives are thermosetting resin adhesives such as epoxy resin adhesives, phenol resin adhesives, or polyphenylene ether resin adhesives having a thermal curing temperature of 100 to 250° C., considering heat resistance required for the liquid discharge device 1, resistance to a liquid such as ink, or the like.

In order to put the thin plate-shaped piezoelectric element 6 in a transverse vibration mode, the polarization of piezoelectric ceramic is oriented in the thickness direction of the piezoelectric element 6, e.g., a direction directed toward the common electrode 23 from the discrete electrode 24. For that purpose, a polarization method such as a high temperature polarization method, a room temperature polarization method, an alternating electric field superimposition method, or an electric field cooling method, for example, is employed. In the piezoelectric element 6 in a transverse vibration mode in which the polarization of piezoelectric ceramic is oriented in the above-mentioned direction, when a positive driving voltage is applied to any of the discrete electrodes 24 with the common electrode 23 grounded, for example, a region, sandwiched between both the electrodes 23 and 24 (referred to as a "driving region"), of the piezoelectric element 6 contracts within a plane perpendicular to the direction of the polarization. However, the piezoelectric element 6 is fixed to the vibrating plate 22 through the common electrode 23. As a result, a region, corresponding to the driving region, of the piezoelectric actuator 7 enters a state where pressure is applied to the liquid in the pressure chamber 3 by being deflected so as to project toward the pressure chamber 3.

When the piezoelectric actuator 7 is vibrated by applying a predetermined driving voltage pulse to the driving region of the piezoelectric element 6 from both the electrodes 23 and 24 to repeat the above-mentioned state and a state where the deflection of the piezoelectric actuator 7 is released without a voltage being applied to the piezoelectric actuator 7 at predetermined timing, therefore, the volume of the pressure chamber 3 is decreased or increased with the vibration so that the liquid in the pressure chamber 3 vibrates. The vibration is transmitted to the nozzle 4 through the liquid in the communication path 5 so that the meniscus of the liquid formed in the nozzle 4 vibrates. This vibration causes a part of the liquid forming the meniscus to be separated as a liquid drop and discharged from the nozzle 4.

EXAMPLES

Example 1

<Board >2

A board 2 including respective pluralities of sections each having a cross-sectional shape shown in FIG. 1 and having the following dimensions was formed by laminating a plurality of plate materials composed of SUS316 in order and integrating the plate materials, as previously described.

(Pressure Chamber 3)

The area thereof in a planar direction of the board 2: 0.273 $mm^2$

The depth thereof in the thickness direction 100 μm (Nozzle 4)

A nozzle 4 has a solid shape including a conical tapered section 25 whose inner diameter gradually decreases from the side of a pressure chamber 3 (the upper side) to the discharge side (the lower side) and a straight section 26, being circular in cross section and having a predetermined inner diameter, provided at an end on the discharge side of the conical tapered section 25. The dimensions of each of the sections were as follows:

The overall length $L_3$ of the nozzle 4: 50 μm

The cone angle of the conical tapered section 25: 8°

The length $L_4$ of the straight section 26: 5 μm

The opening diameter $d_1$ of the straight section 26: 20 μm (the opening area: 0.00031 $mm^2$)

(Communication Path 5)

As shown in FIG. 3, the respective cross-sectional shapes, in a planar direction of the board 2 perpendicular to the length direction of a communication path 5, of a narrow section 9, a region, closer to the nozzle 4 than the narrow section 9, of the communication path 5, and a connection section 12 were made circular.

The dimensions of each of the sections were as follows:

The inner diameter of the narrow section 9: 120 μm (the opening area $S_1$: 0.01131 $mm^2$)

The inner diameter of the region, closer to the nozzle 4 than the narrow section 9, of the communication path 5: 180 μm (the opening area $S_0$ 0.02545 $mm^2$)

The inner diameter of the connection section 12: 150 μm (the opening area: 0.01767 $mm^2$)

The overall length $L_0$ of the communication path 5: 830 μm

The length $L_1$ of the narrow section 9: 100 μm

The length $L_2$ of the connection section 12: 60 μm (Contraction Section 11)

In a contraction section 11, the length thereof in a direction of flow of a liquid from a supply path 10 to a pressure chamber 3 was 302 μm, the width thereof in a planar direction of the board 2 perpendicular to the direction of flow was 39.5 μm, and the height thereof in the thickness direction of the board 2 was 20 μm.

(Piezoelectric Actuator 7)

A piezoelectric actuator 7 having layers, described below, including a thin plate-shaped piezoelectric element 6 in a transverse vibration mode, which were laminated in the order shown in FIG. 1 and having a total thickness of 41.5 μm was prepared. The characteristics of the piezoelectric actuator 7 were as follows:

Piezoelectric constant $d_{31}$: 177 μm/V

Compliance: $26.324\times10^{-21}$ m5/N

Developed pressure constant: 17.925 kPa/V

The amount of displacement in the thickness direction of a region corresponding to a driving region of the piezoelectric element 6 in a case where a driving voltage of 20 V was applied between a common electrode 23 and a discrete electrode 24 was 84.3 nm.

(Vibrating Plate 22)

A vibrating plate 22 was formed of PZT in a thin plate shape having dimensions covering a plurality of pressure chambers 3 on the board 2.

Thickness: 14 μm (Common Electrode 23)

The common electrode 23 was formed of Ag—Pd serving as a conductive material in a film shape having dimensions that were substantially the same as those of the vibrating plate 22.

Thickness: 10 μm (Piezoelectric Element 6)

The piezoelectric element 6 was formed of PZT serving as piezoelectric ceramic in a thin plate shape having dimensions that were substantially the same as those of the vibrating plate 22 and the common electrode 23.

Thickness: 14 μm (Discrete Electrode 24)

The discrete electrode 24 was pattern-formed of Au serving as a conductive material for each of the pressure chambers 3 to a film having a shape corresponding to the planar shapes of the pressure chamber 3.

Thickness 3.5 μm

<Liquid Discharge Device 1>

A piezoelectric ink jet head serving as a liquid discharge device 1 was manufactured by laminating the piezoelectric actuator 7 on a surface, on which the pressure chamber 3 was formed, of the board 2 previously described through epoxy resin adhesives, followed by heating under pressure, to cure epoxy resin.

Examples 2 and 7

A piezoelectric ink jet head serving as a liquid discharge device 1 was manufactured in the same manner as that in the example 1 except that the inner diameter of a narrow section 9 was 70 μm (the opening area $S_1$: 0.00385 $mm^2$, Example 2), 80 μm (the opening area $S_1$: 0.00503 $mm^2$, Example 3), 90 μm (the opening area $S_1$: 0.00636 $mm^2$, Example 4), 100 μm (the opening area $S_1$: 0.00785 $mm^2$, Example 5), 140 μm (the opening area $S_1$: 0.01539 $mm^2$, Example 6), and 160 μm (the opening area $S_1$: 0.02011 $mm^2$, Example 7).

Examples 8 to 15

A piezoelectric ink jet head serving as a liquid discharge device 1 was manufactured in the same manner as that in the example 1 except that the inner diameter of a narrow section 9 was 100 μm (the opening area $S_1$: 0.00785 $mm^2$), and the length $L_1$ of the narrow section 9 was 40 μm (Example 8), 80 μm (Example 9), 90 μm (Example 10), 110 μm (Example 11), 130 μm (Example 12), 150 μm (Example 13), 170 μm (Example 14), and 190 μm (Example 15).

Comparative Example 1

Figure 5:
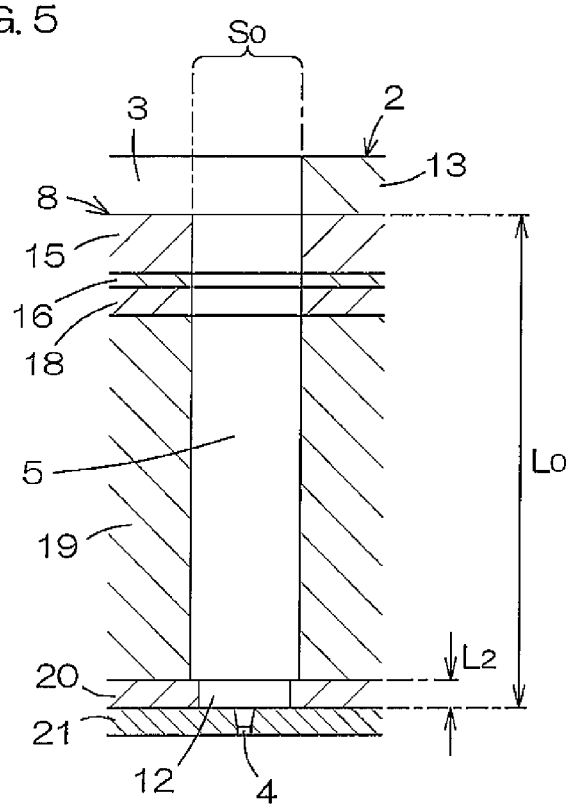
FIG. 5 is a cross-sectional view showing a communication path formed in a comparative example 1 in enlarged fashion.

As shown in FIG. 5, a piezoelectric inkjet head serving as a liquid discharge device 1 was manufactured in the same manner as that in the example 1 except that a communication path 5 was not provided with a narrow section 9. The dimensions of each of the sections were as follows:

The inner diameter of the communication path 5: 180 μm (the opening area $S_0$: 0.0254 $mm^2$)

The inner diameter of a connection section 12: 150 μm (the opening area: 0.0177 $mm^2$)

The overall length $L_0$ of the communication path 5 830 μm

The length $L_2$ of the connection section 12: 60 μm

Comparative Example 2

Figure 6:
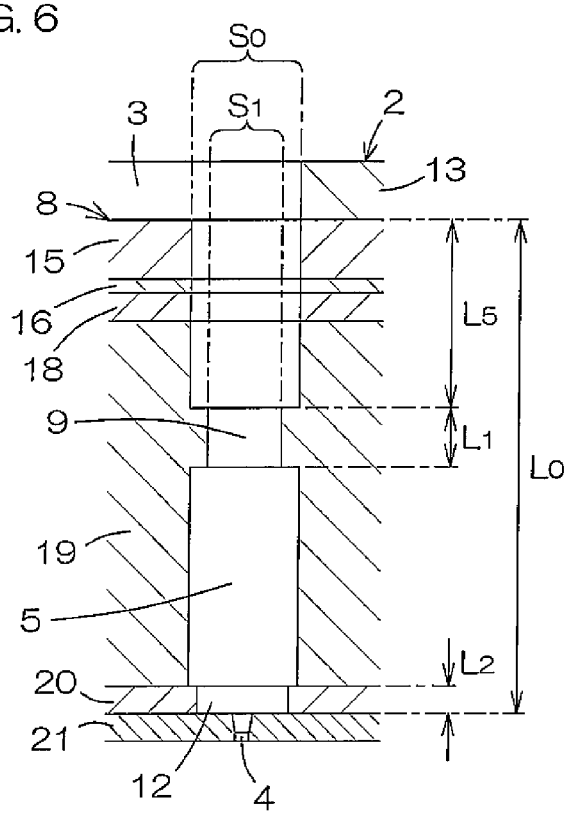
FIG. 6 is a cross-sectional view showing a communication path formed in a comparative example 2 in enlarged fashion.

As shown in FIG. 6, a piezoelectric inkjet head serving as a liquid discharge device 1 was manufactured in the same manner as that in the example 1 except that a narrow section 9 was provided at not a boundary position 8 between a pressure chamber 3 of a communication path 5 but a halfway position of the communication path 5. The dimensions of each of the sections were as follows:

The inner diameter of the narrow section 9: 120 μm (the opening area $S_1$: 0.0113 $mm^2$)

The inner diameter of respective regions, closer to the pressure chamber 3 and a nozzle 4 than the narrow section 9, of the communication path 5: 180 μm (the opening area $S_0$: 0.0254 $mm^2$)

The inner diameter of a connection section 12: 150 μm (the opening area: 0.0177 $mm^2$)

The overall length $L_0$ of the communication path 5: 830 μm

The length $L_1$ of the narrow section 9: 100 μm

The length $L_5$ from the boundary position 8 to an upper end of the narrow section 9: 340 μm The length $L_2$ of the connection section 12: 60 μm Comparative Example 3

Figure 7:
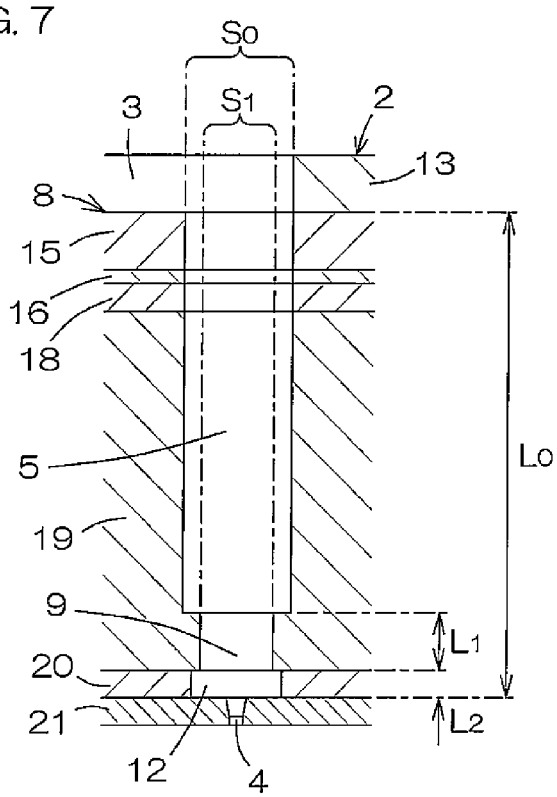
FIG. 7 is a cross-sectional view showing a communication path formed in a comparative example 3 in enlarged fashion.

As shown in FIG. 7, a piezoelectric inkjet head serving as a liquid discharge device 1 was manufactured in the same manner as that in the example 1 except that a narrow section 9 was provided at a position, in contact with a connection section 12 and closer to a nozzle 4, of the communication path 5. The dimensions of each of the sections were as follows:

The inner diameter of the narrow section 9 120 μm (the opening area $S_1$: 0.0113 $mm^2$)

The inner diameter of a region, closer to a pressure chamber 3 than the narrow section 9, of the communication path 5: 180 μm (the opening area $S_0$: 0.0254 $mm^2$)

The inner diameter of the connection section 12 150 μm (the opening area: 0.0177 $mm^2$)

The overall length $L_0$ of the communication path 5 830 μm

The length $L_1$ of the narrow section 9 100 μm

The length $L_2$ of the connection section 12: 60 μm

Comparative Example 4

A piezoelectric inkjet head serving as a liquid discharge device 1 was manufactured in the same manner as that in the example 1 except that an enlarged portion having a larger inner diameter than a communication path 5 [inner diameter: 200 μm (opening area $S_1$: 0.03142 $mm^2$), length $L_1$: 100 μm] was conversely provided at the position of a narrow section 9.

<<Fluid Analysis I>>

Figure 8:
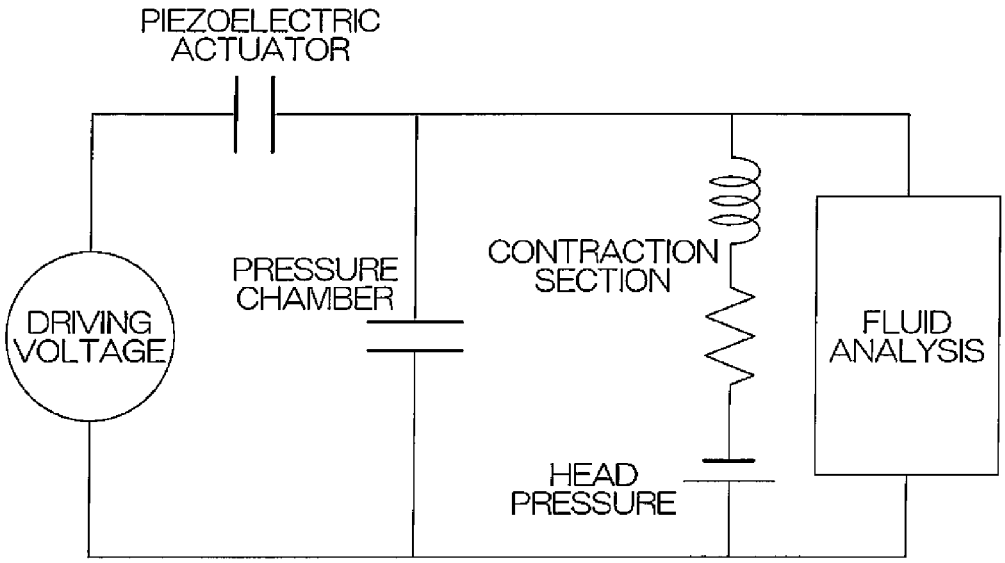
FIG. 8 is a circuit diagram showing an analysis model used for analyzing piezoelectric ink jet heads in examples and comparative examples.
Figure 9:
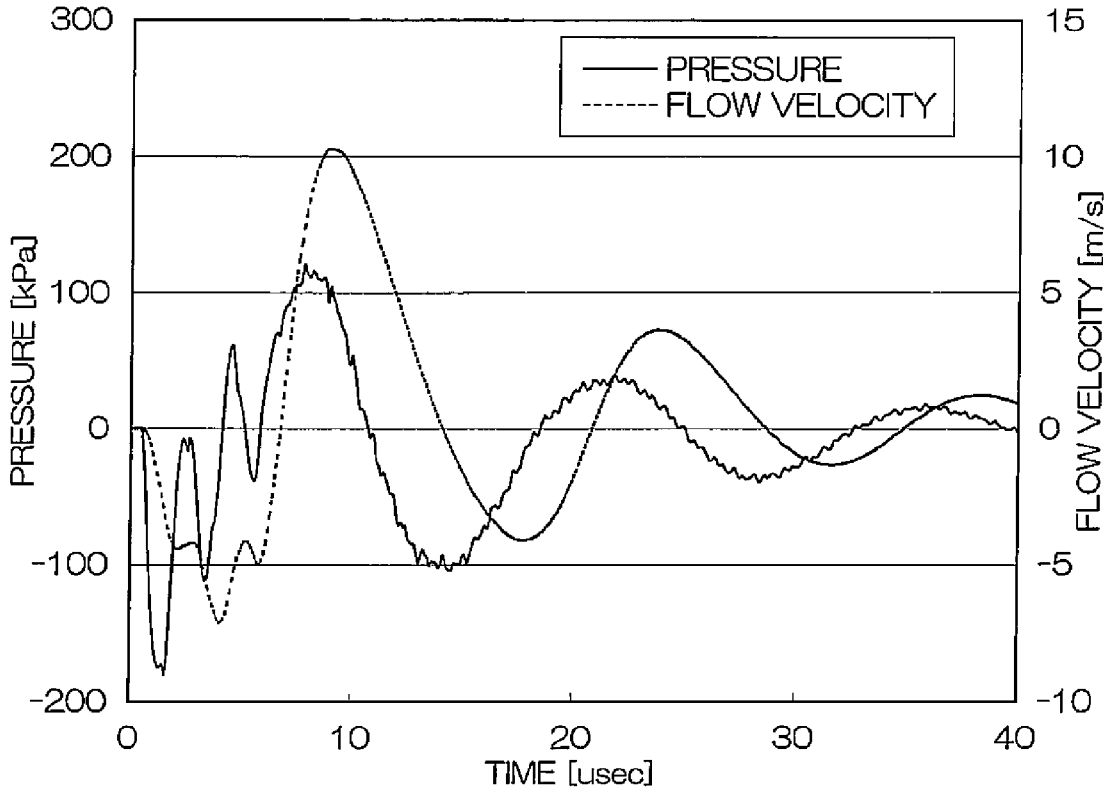
FIG. 9 is a graph showing the changes in the pressure and the flow velocity of a liquid at a boundary position between a communication path and a nozzle in a case where a piezoelectric ink jet head in an example 1 is driven.
Figure 10:
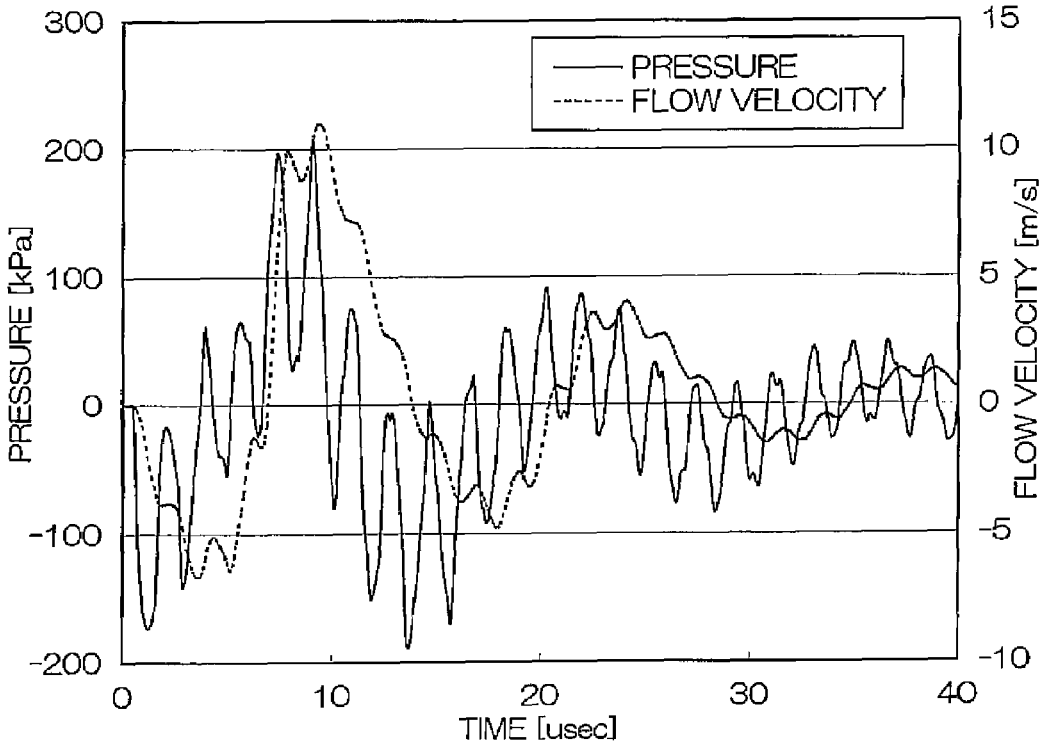
FIG. 10 is a graph showing the changes in the pressure and the flow velocity of a liquid at a boundary position between a communication path and a nozzle in a case where a piezoelectric ink jet head in a comparative example 1 is driven.
Figure 11:
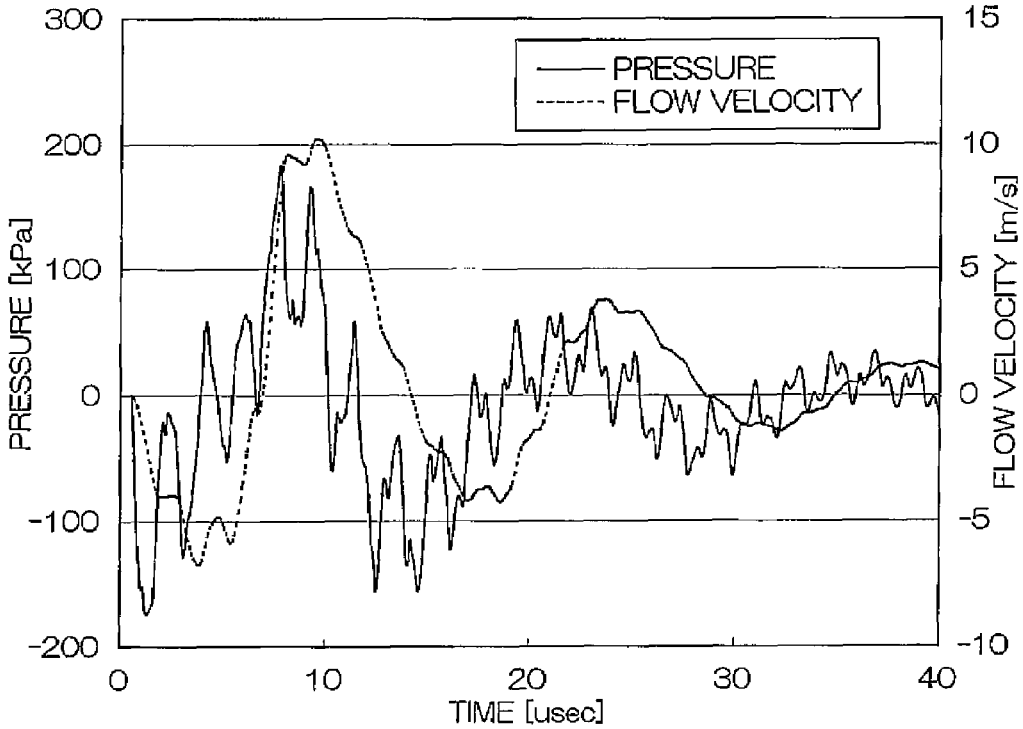
FIG. 11 is a graph showing the changes in the pressure and the flow velocity of a liquid at a boundary position between a communication path and a nozzle in a case where a piezoelectric ink jet head in a comparative example 2 is driven.
Figure 12:
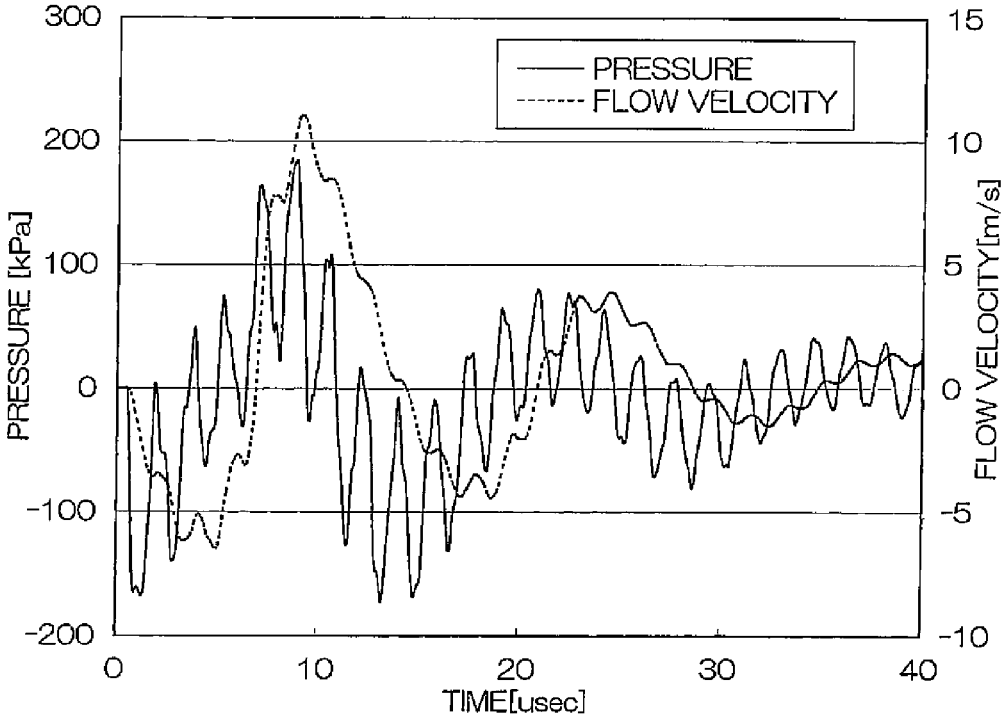
FIG. 12 is a graph showing the changes in the pressure and the flow velocity of a liquid at a boundary position between a communication path and a nozzle in a case where a piezoelectric ink jet head in a comparative example 3 is driven.

In a case where the piezoelectric ink jet heads in the example 1 and the comparative examples 1 to 3 were driven by a so-called Pull-push driving method for continuing to apply a driving voltage to a driving region of the piezoelectric element 6 in a waiting time period, to maintain a state where a region, corresponding to the driving region, of the piezoelectric actuator 7 was deflected so as to project toward the pressure chamber 3, reducing the driving voltage to zero once when a liquid drop was discharged to release the deflection, and then applying a driving voltage again, to return the region to a waiting state, the changes in the pressure and the flow velocity of the liquid at the boundary position between the communication path 5 and the nozzle 4 was fluid-analyzed by a pseudo compression method using an analysis model shown in FIG. 8.

The lattice width for calculation of the analysis model was set to 0.7 μm×0.7 μm in a portion of the nozzle 4 and 2 μm×2 μm in a portion of the communication path 5 including the narrow section 9 and the connection section 12. Furthermore, as the waveform of a driving voltage pulse used for the Pull-push driving method, the voltage value in the waiting time period was set to 15 V, and the pulse width of a pulse for reducing the driving voltage to zero was set to 6.2 μsec. The results in the example 1, the results in the comparative example 1, the results in the comparative example 2, and the results in the comparative example 3 are respectively shown in FIGS. 9, 10, 11, and 12. Each of the drawings proved that micro vibration generated in the communication path 5 could be effectively damped only when the narrow section 9 was formed at the boundary position 8 between the pressure chamber 3 of the communication path 5.

<<Fluid Analysis II>>

When the piezoelectric ink jet heads in the examples 1 to 15 and the comparative examples 1 to 4 were driven by applying a driving voltage pulse having the same waveform as that previously described, the number of liquid drops discharged from the nozzle 4, and the volume and the flying speed thereof were analyzed using the above-mentioned analysis model, to obtain results shown in Tables 1 and 2.

Table 1

TABLE 1

| | Narrow section 9 | | | | | |
|---|---|---|---|---|---|---|
| | Inner diameter [μm] | Opening area $S_1$[$mm^2$] | Area ratio [%] $S_1/S_0 \times 100$ | length $L_1$[μm] | Length ratio [%] $L_1/L_0 \times 100$ | Position |
| Example 1 | 120 | 0.01131 | 44 | 100 | 12 | FIG. 1 |
| Example 2 | 70 | 0.00385 | 15 | 100 | 12 | FIG. 1 |
| Example 3 | 80 | 0.00503 | 20 | 100 | 12 | FIG. 1 |
| Example 4 | 90 | 0.00636 | 25 | 100 | 12 | FIG. 1 |
| Example 5 | 100 | 0.00785 | 31 | 100 | 12 | FIG. 1 |

TABLE 1-continued

| | Narrow section 9 | | | | | |
|---|---|---|---|---|---|---|
| | Inner diameter [μm] | Opening area $S_1$[mm$^2$] | Area ratio [%] $S_1/S_0 \times 100$ | length $L_1$[μm] | Length ratio [%] $L_1/L_0 \times 100$ | Position |
| Example 6 | 140 | 0.01539 | 60 | 100 | 12 | FIG. 1 |
| Example 7 | 160 | 0.02011 | 79 | 100 | 12 | FIG. 1 |
| Example 8 | 100 | 0.00785 | 31 | 40 | 5 | FIG. 1 |
| Example 9 | 100 | 0.00785 | 31 | 80 | 10 | FIG. 1 |
| Example 10 | 100 | 0.00785 | 31 | 90 | 11 | FIG. 1 |
| Example 11 | 100 | 0.00785 | 31 | 110 | 13 | FIG. 1 |
| Example 12 | 100 | 0.00785 | 31 | 130 | 16 | FIG. 1 |
| Example 13 | 100 | 0.00785 | 31 | 150 | 18 | FIG. 1 |
| Example 14 | 100 | 0.00785 | 31 | 170 | 20 | FIG. 1 |
| Example 15 | 100 | 0.00785 | 31 | 190 | 23 | FIG. 1 |
| Comparative example 1 | — | — | — | — | — | FIG. 5 |
| Comparative example 2 | 120 | 0.01131 | 44 | 100 | 12 | FIG. 6 |
| Comparative example 3 | 120 | 0.01131 | 44 | 100 | 12 | FIG. 7 |
| Comparative example 4 | 200 | 0.03142 | 123 | 100 | 12 | — |

Table 2

TABLE 2

| | Total | Overall average | | First drop | | Second or subsequent drop | | | |
|---|---|---|---|---|---|---|---|---|---|
| | number of liquid drops | Flying speed $V_0$[m/s] | Volume $C_0$[pl] | Flying speed $V_1$[m/s] | Volume $C_1$[pl] | Flying speed $V_2$[m/s] | Volume $C_2$[pl] | Speed ratio $V_1/V_0$ | Volume ratio $C_1/C_0$ |
| Example 1 | 2 | 7.1 | 5.3 | 8.0 | 3.0 | 5.9 | 2.3 | 1.1 | 0.57 |
| Example 2 | 2 | 6.3 | 5.3 | 7.7 | 2.7 | 4.9 | 2.7 | 1.2 | 0.50 |
| Example 3 | 2 | 7.1 | 5.2 | 8.0 | 2.9 | 6.1 | 2.4 | 1.1 | 0.55 |
| Example 4 | 2 | 7.1 | 5.3 | 7.9 | 3.0 | 6.1 | 2.3 | 1.1 | 0.56 |
| Example 5 | 2 | 7.1 | 5.5 | 7.8 | 3.0 | 6.2 | 2.5 | 1.1 | 0.55 |
| Example 6 | 2 | 7.1 | 5.5 | 7.7 | 3.0 | 6.2 | 2.5 | 1.1 | 0.54 |
| Example 7 | 2 | 7.5 | 5.3 | 8.7 | 2.7 | 6.2 | 2.6 | 1.2 | 0.51 |
| Example 8 | 2 | 7.3 | 5.4 | 8.2 | 2.7 | 6.3 | 2.6 | 1.1 | 0.51 |
| Example 9 | 2 | 7.1 | 5.5 | 7.8 | 3.2 | 6.1 | 2.3 | 1.1 | 0.58 |
| Example 10 | 2 | 7.0 | 5.6 | 7.8 | 3.1 | 6.0 | 2.5 | 1.1 | 0.56 |
| Example 11 | 2 | 6.9 | 5.2 | 7.9 | 2.8 | 5.8 | 2.4 | 1.1 | 0.54 |
| Example 12 | 2 | 7.1 | 5.2 | 8.0 | 2.7 | 6.1 | 2.5 | 1.1 | 0.52 |
| Example 13 | 2 | 7.0 | 5.3 | 7.9 | 2.8 | 5.9 | 2.5 | 1.1 | 0.53 |
| Example 14 | 2 | 6.9 | 5.3 | 7.9 | 2.7 | 5.8 | 2.5 | 1.1 | 0.52 |
| Example 15 | 2 | 6.4 | 5.3 | 7.7 | 2.7 | 5.1 | 2.7 | 1.2 | 0.50 |
| Comparative example 1 | 2 | 7.7 | 5.3 | 9.2 | 2.6 | 6.3 | 2.7 | 1.2 | 0.49 |
| Comparative example 2 | 3 | 7.3 | 5.2 | 8.5 | 2.7 | 5.9 | 2.5 | 1.2 | 0.52 |
| Comparative example 3 | 4 | 6.6 | 5.3 | 7.4 | 3.2 | 5.5 | 2.1 | 1.1 | 0.60 |
| Comparative example 4 | 4 | 7.2 | 5.6 | 7.9 | 3.1 | 6.2 | 2.5 | 1.1 | 0.56 |

Table 1 and Table 2 showed that in the comparative example 1 in which the narrow section 9 is not provided in the communication path 5, a head high-speed drop, which causes defective images, being minuter and having a higher flying speed than a predetermined liquid drop was discharged as the first drop due to the effect of the micro vibration. Furthermore, in the comparative examples 2 and 3 in which the narrow section 9 was provided at a position other than the boundary position 8 between the pressure chamber 3 of the communication path 5, a large number of liquid drops, which cause defective images, being minuter and having a lower flying speed than a predetermined liquid drop were discharged from the nozzle 4 after the predetermined liquid drop was discharged due to the effect of the micro vibration. Furthermore, in the comparative example 4 in which the enlarged portion having a larger inner diameter than the communication path 5 was conversely provided at the position of the narrow section 9, a large number of liquid drops, which cause defective images, being minuter and having a lower flying speed than a predetermined liquid drop were also discharged from the nozzle 4 after the predetermined liquid drop was discharged due to the effect of the micro vibration.

On the other hand, it was confirmed in the examples 1 to 15 that only two liquid drops that have a predetermined volume and flying speed and may not cause defective images could be discharged. Furthermore, comparison among the examples proved that it was preferable from the results in the examples 1 to 7 that the opening area of the narrow section 9 was 20 to 60% of the opening area of the region closer to the nozzle 4 than the narrow section 9, and it was preferable from the results in the examples 1 and 8 to 15 that the length, in the length direction of the communication path 5, of the narrow section 9 was to 20% of the overall length of the communication path 5.

The invention claimed is:

1. A liquid discharge device comprising:

a pressure chamber to be filled with a liquid;

a nozzle for discharging the liquid as a liquid drop;

a communication path that interconnects the pressure chamber and the nozzle and to be filled with a liquid; and a piezoelectric actuator that includes a piezoelectric element, and vibrates due to the deformation of the piezoelectric element to increase or decrease the volume of the pressure chamber, to vibrate the liquid in the pressure chamber and transmits the vibration to the nozzle through the liquid in the communication path, to discharge the liquid drop from the nozzle, wherein a region having 10 to 20% of the overall length of the communication path directed toward the nozzle from a boundary position is a narrow section having a smaller opening area than a opening area of a region closer to the nozzle than the narrow section of the communication path, wherein the boundary section is between the pressure chamber and the communication path.

2. The liquid discharge device according to claim 1, wherein the opening area of the narrow section is 20 to 60% of the opening area of the region closer to the nozzle than the narrow section.

* * * * *